United States Patent [19]

Rolek

[11] Patent Number: 4,941,289

[45] Date of Patent: Jul. 17, 1990

[54] REFRIGERATOR DOOR FRAME WITH INSULATED MULLION

[75] Inventor: Matthew Rolek, Chicago, Ill.

[73] Assignee: Ardco, Inc., Chicago, Ill.

[21] Appl. No.: 328,472

[22] Filed: Mar. 24, 1989

Related U.S. Application Data

[63] Continuation-in-part of Ser. No. 131,182, Dec. 10, 1987, Pat. No. 4,852,303.

[51] Int. Cl.[5] ..... E06B 1/32

[52] U.S. Cl. ..... 49/504; 49/478

[58] Field of Search ..... 62/248, 219, 275; 49/504, 478, 365, 381, DIG. 1

[56] References Cited

U.S. PATENT DOCUMENTS

| | | | |
|---|---|---|---|
| 3,673,735 | 7/1972 | Winsler et al. | 49/478 X |
| 4,815,245 | 3/1989 | Gartner | 49/DIG. 1 |
| 4,831,780 | 5/1989 | Bockwinkel | 49/478 X |

*Primary Examiner*—James R. Brittain

*Attorney, Agent, or Firm*—Leydig, Voit & Mayer

[57] ABSTRACT

A refrigerator door assembly having a door mounting frame with at least one mullion that includes a primary metallic structural frame member, a plastic insulating plate positioned adjacent a rear side of the primary structural frame member, a channel shaped frame member having forwardly directed legs engageable with the insulating plate, and fasteners interconnecting the first and channel shaped frame members with the insulating plate interposed therebetween. A magnetically attractable sealing plate is mounted forwardly on the mullion for defining a stop and sealing surface for the swinging ends of pivotably mounted doors. The mullion includes an insulating and sealing plate retaining assembly which supports the sealing plate in thermally isolated relation to the frame members and defines air insulating spaces adjacent the primary structural frame member. The illustrated insulating and sealing plate retaining assembly includes a plastic channel shaped member having a front wall disposed in closely adjacent relation to a front side of the primary structural frame member and side walls extending in rearwardly directed fashion therefrom. The insulating plate between the channel shaped and primary frame members is releasably engageable with the rearwardly extending side walls for completely encapsulating the primary structural frame member. Various metallic accessory items are supportable on the mullion in substantially thermally isolated relation to the primary structural frame member.

35 Claims, 4 Drawing Sheets

REFRIGERATOR DOOR FRAME WITH INSULATED MULLION

DESCRIPTION OF THE INVENTION

This is a continuation in part of application Ser. No. 131,182, filed Dec. 10, 1987 Pat. No. 4,852,303.

The present invention relates generally to door assemblies for commercial refrigerators and freezers, and more particularly, to an improved more thermally efficient mullion for the door mounting frame of such door assemblies.

Insulated glass door assemblies, such as used in commercial refrigerators and freezers in supermarkets and the like, generally comprise a plurality of insulated glass doors mounted for swinging movement in a door mounting frame, which in turn is mounted within the opening of a wall of a refrigerator cabinet or the like. The door mounting frame extends about the periphery of the opening in the cabinet wall and includes one or more mullions that extend vertically between the top and bottom perimeters of the frame to provide rigidity for the frame and a sealing surface against which the swinging sides of the doors engage when closed.

Because the insulated doors usually comprise a plurality of glass panes, they are relatively heavy and require a sturdy and rugged frame for supporting their weight and for withstanding abusive repeated opening and closing that occurs in commercial establishments. The mullions, therefore, typically include a metal structural frame member, such as an aluminum extrusion, which is highly heat conductive. Moreover, in order to provide a magnetically attractive sealing surface against which a door mounted magnetic gasket is engageable for establishing reliable sealing contact, it is common to affix a metal sealing plate to the front of the mullion.

For ensuring reliable contact of the magnetic gasket with the sealing strip, notwithstanding adjustable mounting of the door in the frame, the sealing strip typically is sized larger than the magnetic gasket, and indeed, generally extends completely across the width of the mullion so that it serves as a sealing surface for doors mounted on both sides thereof. As a result, even when the doors are in their closed positions, the metal sealing plate on the mullion often extends between the ambient air and refrigerated sides of the sealing gasket. If preventative measures are not taken, portions of the sealing plate exposed to the ambient air for prolonged periods will cool below the dew point temperature of the ambient air, resulting in the formation of frost on the surface of the sealing plate. Further frosting problems result when metal accessories, such as lock plates, lighting fixtures, or the like are affixed to the mullion. In an effort to prevent such frost buildup, it has been the practice to electrically heat the metal frame and sealing plate so as to maintain exposed portions of the sealing plate and accessories above the dew point temperature of the ambient air. Such electrical heating can significantly increase the operating cost of the refrigerator or freezer unit.

While considerable efforts have been directed toward combating condensation build up and minimizing heating requirements, such as by insulating the frame or interrupting the heat conductive path through the frame by means of thermal barriers or breaks, these efforts have not been entirely successful and often complicate the manufacture of the frame. For example, one approach has been to create a thermal break in the door mounting frame by forming the aluminum extrusion with a channel shaped opening, pouring hot melt plastic material into the opening which solidifies in intimate contact with the channel, and thereafter severing the channel to separate the frame into independent sections separated by the solid plastic. Such procedure is highly time consuming, and hence, significantly adds to the manufacturing cost of the product. Proposals to change the material of the frame so that it is less expensive or less heat conductive generally have not been adopted, usually by reason of strength considerations and the desire that the frame have an attractive metal finish consistent with existing commercial freezers and refrigerators.

It is an object of the present invention to provide an improved, more thermally efficient mullion for the door mounting frame of commercial refrigerator and freezer door assemblies. A related object is to provide such a mullion that has relatively high strength and rigidity and is adapted for condensation-free use in commercial refrigerator and freezer units with reduced electrical heating requirements.

Another object is to provide a mullion of the above kind which has a thermal break between separate inner and outer structural frame members of the mullion. A related object is to provide such a mullion which is of relatively simple construction and lends itself to economical manufacture.

A further object is to provide a mullion as characterized above which includes a magnetically attractive sealing plate mounted in thermally isolated relation to the structural frame members.

Still a further object is to provide a mullion of the foregoing type that includes a sealing plate mounting means which encapsulates a forwardmost structural frame member for thermally insulating the sealing plate from the refrigerated zone.

Yet another object is to provide such a mullion which permits secure, thermally-insulated mounting of metallic accessories, such as door lock plates, lighting fixtures, and the like.

Other objects and advantages of the invention will become apparent upon reading the following detailed description and upon reference to the drawings, in which.

Figure 1:
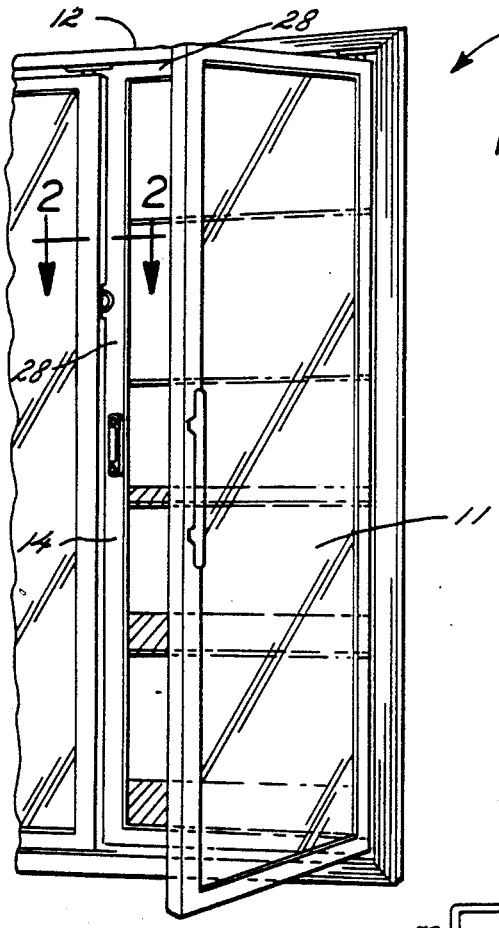
FIG. 1 is perspective of a refrigerator door assembly having a door mounting frame with a mullion in accordance with the present invention.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Referring now more particularly to FIGS. 1–4 of the drawings, there is shown an illustrative refrigerator door assembly 10, comprising a plurality of insulted glass doors 11 mounted for swinging movement in a door mounting frame 12, which in turn typically is mounted within the opening of a front wall of a refrigerator cabinet or the like. It will be understood that he door assembly 10 is particularly adapted for use in free standing refrigerator or freezer cases or built-in coolers or cabinets of the type used in supermarkets and other retail stores to display refrigerated or frozen merchandise. The door mounting frame 12 extends about the periphery of the opening in the wall and includes one or more mullions 14 that extend vertically between the top and bottom perimeters of the frame to provide rigidity for the frame 12 and define a sealing surface against which the free swinging sides of the doors 11 engage when in a closed condition.

The insulated glass doors 11 in this case each include an insulated glass unit 15 (FIG. 2), which may be of a known type comprising a plurality of glass panes disposed in parallel side by side relation with a tubular spacer positioned in sealed relation about the perimeter. The glass unit 15 is supported within an outer metal frame member 18, which preferably is an aluminum extrusion, the frame member 18 defining a rearwardly opening channel 19 and having a front leg 20 positioned in adjacent relation to a front side of the glass unit 15. A separate retaining member 21 is releasably engageable in the channel 19 of the frame member 18 for retaining a rear side of the glass unit. A plastic or other non-metallic, resilient sealing member 22 is interposed between the leg 20 of the frame member 18 and the glass unit 15 to provide a seal about the forward peripheral edge of the glass unit.

Figure 2:
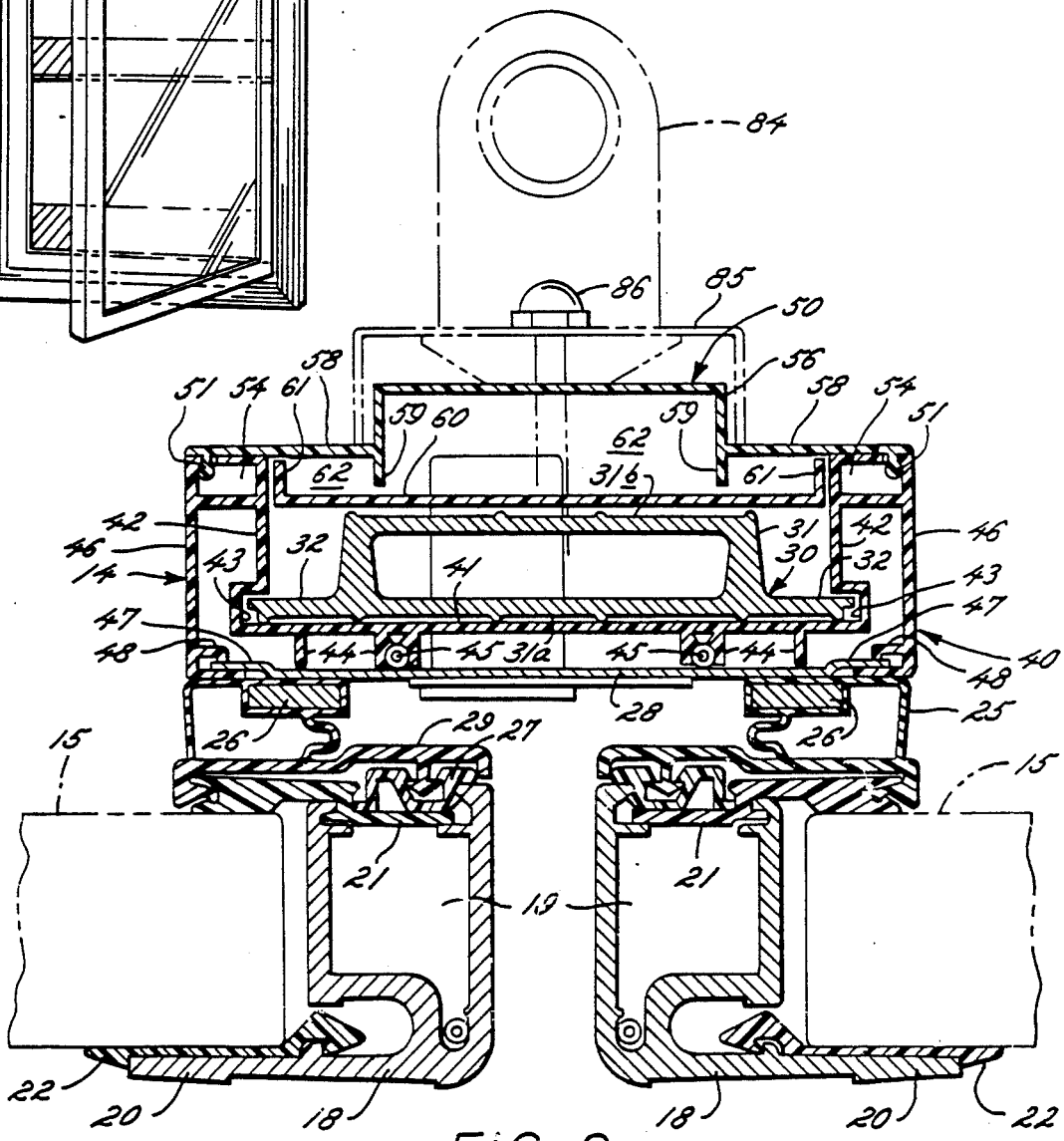
FIG. 2 is an enlarged fragmentary section taken in the plane of line 2—2 in FIG. 1, showing the mullion of the present invention with the free swinging sides of a pair of doors on opposed sides thereof in their closed position.
Figure 3:
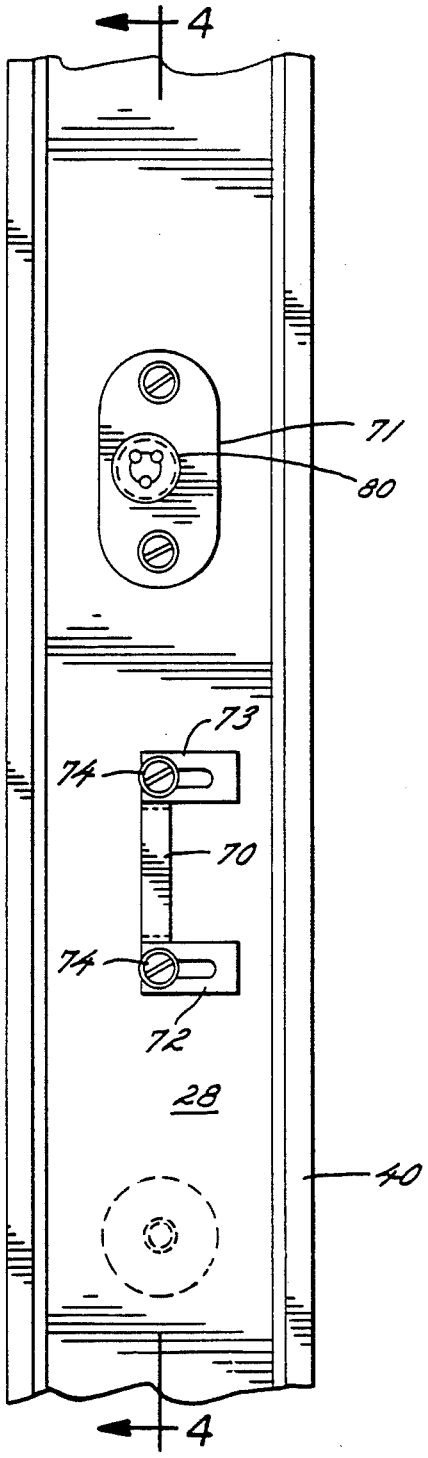
FIG. 3 is an enlarge partial plan view of a front of the illustrated mullion, showing accessories mounted therein.
Figure 4:
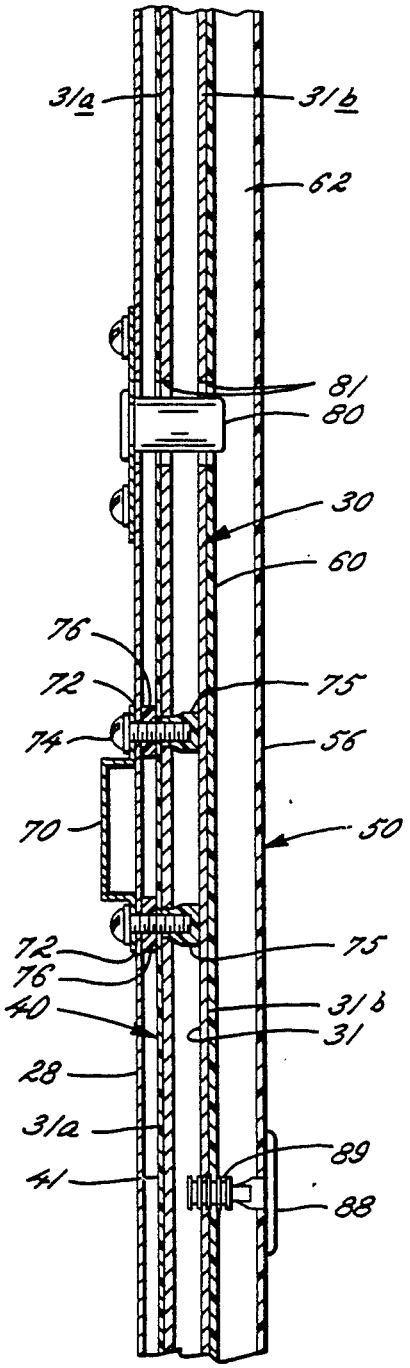
FIG. 4 is a fragmentary vertical section of the illustrated mullion, taken in the plane of line 4—4 in FIG. 3.

For providing a seal between the door 11 and the cabinet frame 12 when the door is in a closed position so as to prevent the entry of warm air from the ambient air side into the refrigerated zone, a gasket 25 is secured to the rear side of each door 11. The gasket 25 contains magnets 26 for creating a magnetic attraction with a metallic sealing plate or strip 28, preferably made of a metallic or vinyl clad material, mounted on the frame 12 about the periphery of the door opening for defining a sealing and stop surface for the doors. The gasket 25 is affixed to a carrying plate 27 that is adapted for snap action engagement with the retaining member 21. Typical of the prior art, the sealing plate 28 on the front of the mullion 14 extends across substantially the width of the mullion so as to provide a sealing surface for doors on both sides thereof, as shown in FIG. 2. Because the sealing plate 28 is highly heat conductive and extends across the ambient air and refrigerated sides of a door mounted gasket engaged therewith, heretofore it has been susceptible to frost buildup.

In keeping with the invention, each mullion includes a rigid metallic structural frame member and means for supporting the magnetically attractive sealing plate on the structural frame member in the thermally isolated relation thereto for enhancing the thermal operating efficiency of the mullion. In the illustrated embodiment, the mullion 14 includes a first or primary structural frame member 30 which preferably is made of aluminum or other high strength metal and has an elongated hollow section 31 with outwardly extending flanges 32 on opposite sides thereof The hollow section 31 in this instance is generally rectangular in configuration with the long sides of the rectangle defining forward and rear faces 31', 31", respectively, of the frame member. The flanges 32 extend outwardly from the hollow section 31 with forward faces thereof in substantial co-planer relation to the forward face 31" of the frame member 30. The hollow configuration of the structural frame member 30 has been found to enhance the strength and rigidity of the mullion, while the air space defined within the hollow section 31 tends to insulate the forward and rear faces 31', 31" from each other, and thus, enhance the thermal efficiency.

For supporting the sealing plate in thermally isolated relation to the metallic structural frame member, a non-metallic, generally channel-shaped insulating and retaining member 40 is disposed about a front face of the structural frame member 30 for supporting the sealing plate 28 in forwardly spaced relation to the frame member with an air insulating space therebetween. The insulating and retaining member 40, which may be made of PVC or other substantially rigid plastic material, has a generally C-shaped configuration with a front wall 41 that is substantially co-extensive with the front of the structural frame member 30 and first or inner side walls 42 that extend rearwardly beyond the plane of the rear face 31" of the structural frame member 30. The inner side walls 42 in this instance are laterally spaced from each other slightly less than the distance between the outer edges of the flanges 32 of the structural frame member 30 and are formed with a pair of inwardly opening channels 43 shown in FIG. 2 adjacent their forward ends for captively receiving the opposed edges of the flanges 32. The front wall 41 of the insulating and retaining member 40 has a plurality of forwardly extending ribs 44 that support the sealing plate 28 in spaced relation to the front wall 41 of the insulating or retaining member 40 and define a plurality of air spaces therebetween. The ribs 44 further define longitudinally extending grooves within which one or more electrical heating wires 45 may be positioned and retained. In the illustrated embodiment, electrical heating wires 45 are disposed in grooves defined by the ribs 44 at positions adjacent to where the outer peripheral edge of the door mounted sealing gasket 25 engages the sealing plate so as to ensure that the portion of the sealing plate exposed to ambient air for prolonged periods when the doors are closed remain above the dew point temperature of the ambient air.

For positively engaging and retaining the opposed sides of the sealing plate 28, the insulating and retaining member 40 is formed with second or outer side walls 46 that are coupled to the inner side walls 42 at locations adjacent their rearward ends so as to permit limited pivotal movement of the forward ends thereof. The forward ends of the outer side walls 46 are formed with opposed inwardly directed channels 48 that can be forced outwardly with the side walls 46, by virtue of the inherent resiliency of the plastic material from which the insulating and retaining member is formed, to permit insertion of peripheral sides 47 of the sealing plate 28 into the channels 48. Upon release, the sides 46 snap back to their original position with the channels 48 captively engaging the opposed peripheral sides 47 of the sealing plate 28. Alternatively, it will be understood that the sealing plate 28 could be assembled into the insulating and retaining member 40 simply by telescopically positioning the sealing plate into the channels 48 of the side walls 46. The peripheral sides 47 of the sealing plate 28 in this case are recessed inwardly slightly such that the front sealing surface defined by the sealing plate 28 is in substantially the same plane as the forward sides of the channels 48.

For enclosing the rear side of the structural frame member and creating an air insulating zone adjacent thereto, a non-metallic closure member 50, again preferably made of substantially rigid PVC plastic material, is releasably engageable with the rear of the retaining and insulating member 40. The illustrated closure plate 50 is formed with forwardly facing mounting ribs 51, which in this instance have enlarged generally cylindrical terminal ends. For releasably receiving the closure plate mounting ribs 51, the rear terminal ends of the inner and outer side walls 42, 46 of the retaining and insulating member 40 define channels 54 with a relatively narrow width entry opening, corresponding substantially to the thickness of the walls of the closure plate mounting ribs 51, but slightly less than the diameter of the cylindrical terminal ends thereof. The terminal ends of the mounting ribs 51 may be forced through the openings and into the channels 54, with the closure plate thereby being positively retained in mounted position.

The illustrated closure plate 50 has a rearwardly extending central section 56 adapted to facilitate mounting of accessories, as will become apparent. The rearwardly extending central section 56 has forwardly directed walls 59 for stabilizing the cover plate 50 and maintaining the proper spaced relation of the cover plate 50 with respect to the structural frame member 30. In this instance, a separate inner plastic, insulating plate 60 is interposed between the cover plate 50 and the structural frame member 30, which together with the cover plate, defines an air insulating space 62 adjacent the rear side of the structural frame member 30. The insulating plate 60 includes rearwardly directed flanges 61 for enhancing the rigidity of the assembly. It will be understood that the closure plate 50 and further insulating plate 60 could be formed as a single member.

It will be seen from the foregoing that the nonmetallic insulating and sealing plate retaining assembly, comprising the plastic retaining member 40, cover plate 50, and insulating plate 60, not only maintains the sealing plate 28 in thermally insulated relation to the metallic structural member 30, but defines an air insulating space which completely surrounds the structural frame member 30. The hollow configuration of the structural frame member 30 further enhances the thermal efficiency of the mullion. Hence, while the magnetically attractive sealing plate 28 extends completely across the front of the mullion, the portions of the sealing plate 28 that are exposed to ambient air for prolonged periods may be maintained above the dew point temperature of the ambient air with relatively minimal electrical heating requirements as compared to conventional mullion designs.

The mullion 14 further is adapted for supporting commonly used accessories in substantially thermally insulated relation to the metallic structural frame member 30. In the illustrated embodiment, a lock strike plate 70 and an electrical inlet 71 are supported on a central forwardly facing side of the sealing plate 28. The lock strike plate 70 is a conventional metal stamped part having a generally C-shaped configuration with opposed flanges 72 for mounting on the sealing plate 28. For securing the lock strike plate 70 in thermally isolated relation to the structural frame member 30, fastening screws 74 each are engageable in respective plastic inserts 75 disposed between the sealing plate 28 and the structural frame member 30. The inserts 75 are expandable upon threaded engagement by the fasteners 74 for positively retaining the fasteners in their engaged positions. The inserts 75 also encapsulate the rearwardly extending ends of the fasteners 74 to insulate them from the structural frame member 30. A plastic spacer 76 preferably also is interposed between the sealing plate 28 and the front wall 41 of the insulating and retaining member 40 for maintaining proper spacing.

The electrical outlet 71, which may be of a known type such as shown in U.S. Pat. No. 4,578,902 assigned to the same assignee as the present application, may similarly be mounted in thermally insulated relation to the structural frame member 30. A rearwardly extending cylindrical body portion 80 of the electrical outlet 71 in this instance extends through oversized apertures 81 in the structural frame member 30 so as to ensure that no metal-to-metal contact exists.

In carrying out the invention, the mullion 14 includes a metallic channel-shaped frame member 85 mounted rearwardly of and in substantially thermally isolated relation to the first or primary structural frame member 30. The channel shaped member 85 in this instance is generally U-shaped with forwardly directed legs 87 mounted in abutting relation against the rear side of the closure plate 50. Mounting studs 86 extend through a rear wall 90 of the channel member 85 and cover plate 50 and are affixed to the central structural frame member 30 for secure mounting. Appropriate insulating means, such as plastic sleeves 91, again may be utilized for insulating the mounting bolts 86 from the structural frame member 30. For further maintaining the cover plate 50 in securely mounted relation on the structural frame member 30, a plurality of retaining members 88 (FIG. 4) having plastic Christmas type inserts 89 are positionable through respective mounting apertures in the structural frame member. In the illustrated embodiment, a vertically extending light fixture 84 is mounted on the rear wall 90 of the channel member 85 (FIG. 2). It will be seen that the channel member 85 enables secure mounting of lighting or other fixtures on the rear side of the mullion, while the metallic channel member and accessories are maintained in thermally isolated relation to the primary structural frame member 30 by the cover plate 50.

Figure 5:
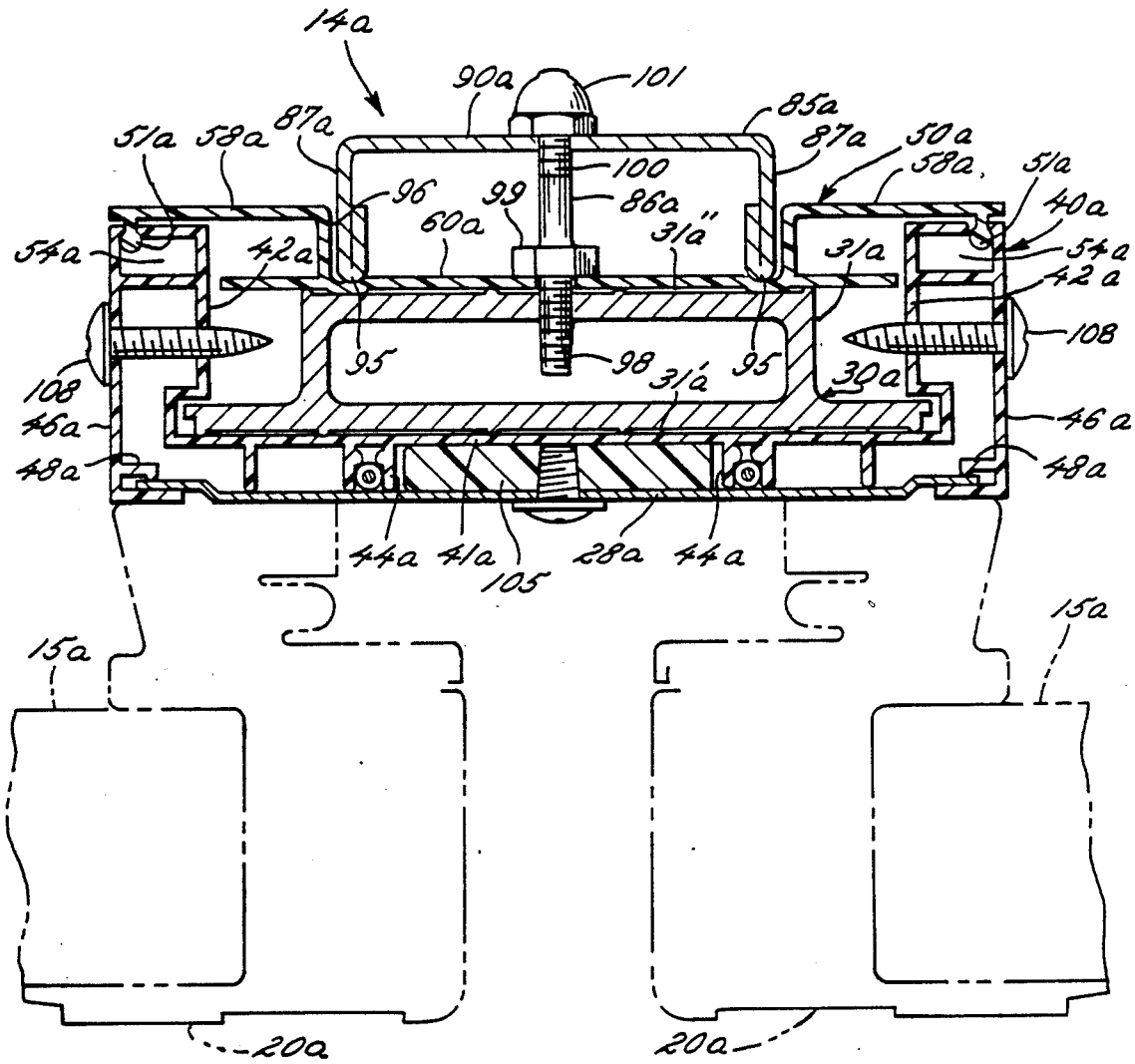
FIG. 5 is a fragmentary transverse section of an alternative embodiment of a mullion in accordance with the present invention, with the free-swinging sides of a pair of doors shown in phantom in their closed position on opposed sides of a front side of the mullion.
Figure 6:
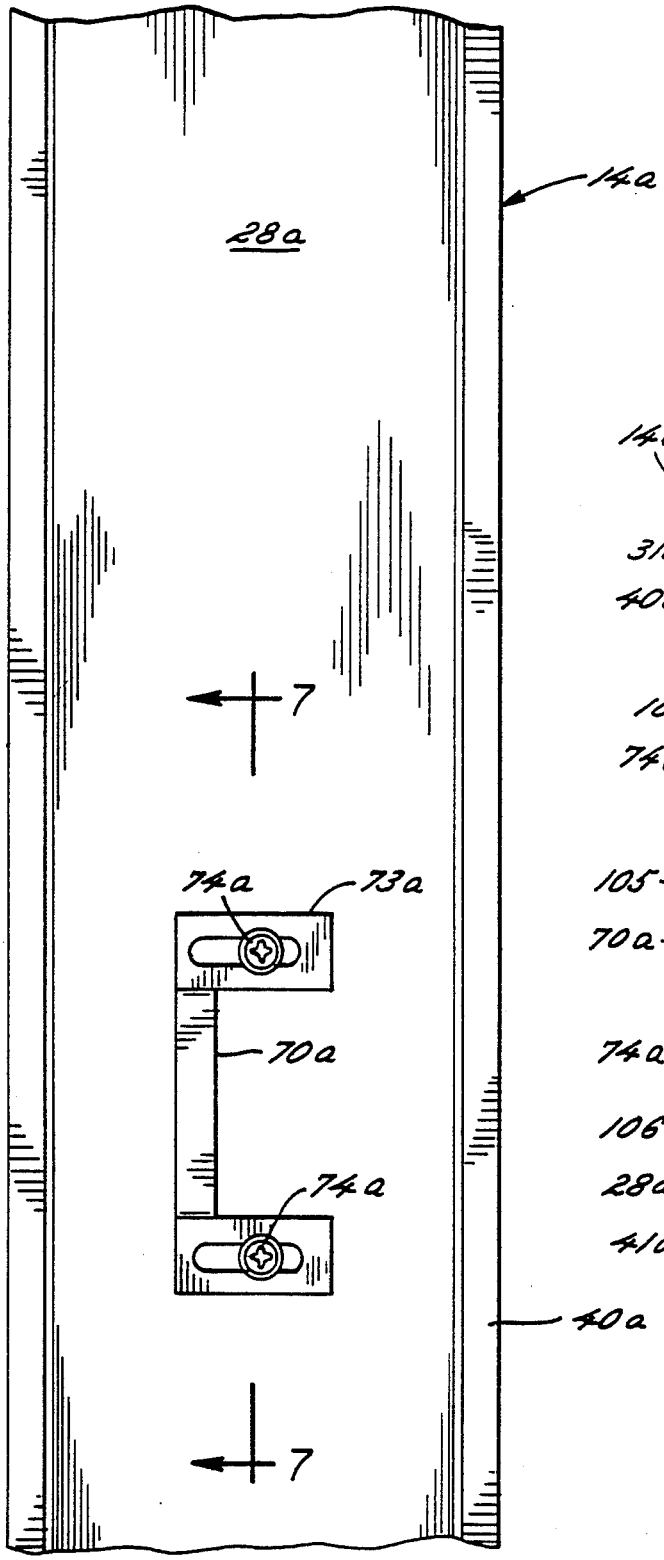
FIG. 6 is an enlarged partial plan view of a front side of the mullion shown in FIG. 5, showing an accessory mounted thereon.
Figure 7:
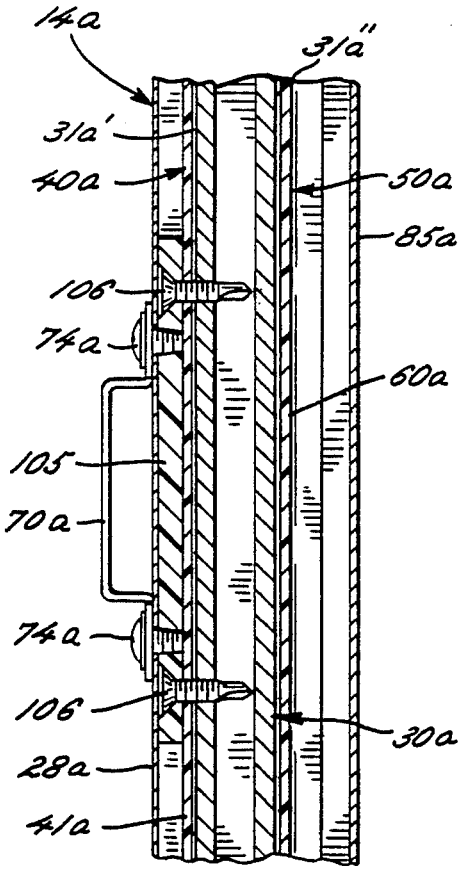
FIG. 7 is a fragmentary section, taken in the plane of line 7—7 in FIG. 6.

Referring now to FIGS. 5–7, there is shown an alternative embodiment of mullion **14*a* in accordance with the present invention wherein items similar to those described above have been given similar reference numerals with the distinguishing suffix "a" added. The mullion 14*a* includes a first or primary structural frame member 30*a* and a non-metallic, preferably plastic, insulating assembly comprising a generally C-shaped insulating and retaining member 40*a* and a rear closure plate 50*a* which completely encapsulate the primary structural frame member 30*a* and support a sealing plate 28*a* in thermally isolated relation to a front side of the structural frame member 30*a***. The structural frame member 30*a*, C-shaped insulating and retaining member 40*a*, and sealing plate 28*a* are identical to those previously described.

In carrying out the embodiment of the invention, the mullion 14*a* includes a channel shaped metallic frame member 85*a*, preferably made of steel, which is rigidly mounted rearwardly of the central structural frame member 30*a* with the plastic rear cover plate 50*a* interposed therebetween and forming a thermal barrier between front and rear sides of the mullion. In the illustrated embodiment, the channel frame member 85*a* has a rear wall 90*a* and a pair of forwardly directed legs 87*a*. The legs 87*a* each have inwardly turned ends 95 for defining rounded bearing surfaces for engaging the rear closure plate 50*a* without damage and added strength.

The rear closure plate 50 in this instance is formed with a substantially flat central barrier plate section 60*a* mounted adjacent the rear face 31″*a* of the primary structural frame member 30*a*. The barrier plate section 60*a* extends outwardly in transverse relation to opposed sides of the rear face 31″*a* of the structural frame member 30*a* to points in close proximity with the inner side walls 42*a* of the insulating and retaining member 40*a*. L-shaped walls 58*a* are formed in rearwardly extending fashion from the barrier plate section 60*a* for enhancing rigidity of the closure plate 50*a* and for defining a central rearwardly opening channel 96 within which the channel frame member 85*a* is mounted. Outer ends of the L-shaped legs 58*a* are formed with forwardly facing mounting ribs 51*a* that are engageable in respective channels 54*a* defined by the terminal ends of the inner and outer sidewalls 42*a*, 46*a* of the insulating and retaining member 40*a*.

For interconnecting the channel frame member 85*a* and primary structural frame member 30*a*, together with the barrier plate section 60*a* interposed therebetween, a plurality of studs 86*a* are provided which each have a threaded end 98 adapted for self-threading engagement with an aperture in the rear of the primary structural frame member 30*a*. To facilitate turning of the studs by a wrench, the studs 86*a* each have an integrally formed hex head 99 intermediate their ends. The studs 86*a* may be threaded into the rear side of the structural frame member 30*a* until the hex head 99 forces the barrier plate section 60*a* of the rear closure plate 50*a* firmly against the rear face 31″*a* of the frame member 30*a*. The channel frame member 85*a* may then be positioned within the channel 96 of the closure plate 50*a* with a rearwardly extended threaded end 100 of each stud 86*a* extending through a respective mounting aperture in the rear wall 90*a* of the channel frame member 85*a*. The channel frame member 85*a* is rigidly secured in mounted position by retaining nuts 101 that each engage the protruding threaded ends 100 of the studs 86*a*.

When rigidly interconnected in such manner, the primary structural frame member 30*a* and the channel frame member 85*a* form a high strength mullion, with the cover plate 50*a* serving as an effective thermal break between forward and rear sides of the mullion. The channel frame member 85*a* provides both enhanced structural rigidity for the mullion 14*a* and reliable mounting of accessories rearwardly of the mullion. The mullion 14*a* further lends itself to relatively simple assembly, without the usual casting of fluid plastic and subsequent milling typically required in making conventional thermal break frames.

In keeping with a further aspect of the invention, the mullion 14*a* includes means which facilitate rigid, thermally isolated mounting of accessories on a front side thereof. In the illustrated embodiment, a rigid plastic spacer plate 105 is provided between the sealing plate 28*a* and the front wall 41*a* of the insulating and retaining member 40*a* and is sized to completely occupy the space between the wire mounting ribs 44*a*. The plastic spacer plate 105 is secured to the structural frame member 30*a* by mounting screws 106 which pass through the spacer plate 105 (FIG. 7), the front wall 41*a* of the insulating and retaining member 40*a*, and into threaded engagement with the front wall of the structural frame member 30*a*.

Accessories, such as a lock plate 70*a* shown in FIGS. 6 and 7, may be rigidly mounted on the front face of the sealing plate 28*a* by mounting screws 74*a* directed through the sealing plate 28*a* and into threaded engagement with the plastic spacer plate 105, the latter of which is securely supported on the structural frame member 30*a* by its own mounting screws 106. Since neither the plastic spacer plate mounting screws 106, nor the accessory mounting screws 74*a* are in contact with both the structural frame member 30*a* and the sealing plate 28*a*, the accessory and its mounting fasteners are maintained in thermally isolated relation to the structural frame member 30*a*. As shown in FIG. 7, the plastic spacer plate 105 need not extend the entire length of the mullion, but may be utilized along sections of the mullion where accessories are to be mounted.

It will be seen that such securement of accessories to the front side of the mullion also serves to secure the sealing plate 28*a* to the spacer plate 105, and in turn, to the structural frame member 30*a*. For maintaining reliable engagement of the outer peripheral sides of the sealing plate 28*a* in respective channels 48*a* defined by the insulating and retaining member 40*a*, fasteners 108 in this instance threadedly engage aligned apertures in the side walls 42*a*, 46*a* of the insulating and retaining member 40*a* so as to prevent deflection of the outer side wall 46*a* and channel 48*a* formed thereon relative to the sealing plate during handling of the mullion. Alternatively, plastic Christmas-type fasteners may be forcefully inserted through aligned apertures for retaining the side walls 42*a*, 46*a* in secure relation to each other.

From the foregoing, it can be seen that the mullion of the present invention has relatively high strength and rigidity while being adapted for condensation free use in commercial refrigerator and freezer units with minimal electrical heating requirements. The non-metallic sealing plate mounting assembly not only securely supports the vinyl clad sealing plate in thermally insulated relation to the metallic structural frame members of the mullion, it further defines a thermal insulating barrier between separate metallic frame sections of the mullion and air insulating spaces adjacent critical areas of the primary structural frame member. Yet, the mullion has a relatively simple construction which lends itself to economical manufacture.

I claim as my invention:

1. A refrigerator door assembly mountable within the opening in the wall of a refrigerated cabinet comprising a door mounting frame having an outer peripheral portion mountable within said cabinet opening, a plurality of insulated doors mounted for pivotal movement on said frame, said frame including at least one mullion extending between top and bottom sides thereof and against which said doors close, said mullion including a first metallic structural frame member, a plastic insulating plate positioned rearwardly of said first metallic frame member.

said mullion including a first metallic structural frame member, a plastic insulating plate positioned rearwardly of said first metallic frame member, a metallic channel shaped frame member having forwardly directed legs engageable with said insulating plate, and means extending through said plastic insulating plate positively interconnecting said first and channel shaped frame members with said plastic insulating plate interposed therebetween.

2. The refrigerator door assembly of claim 1 in which said insulating plate defines a rearwardly opening channel within which said channel shaped frame member is mounted.

3. The refrigerator door assembly of claim 1 in which said first structural frame member and said channel shaped frame member are made of different materials.

4. The refrigerator door assembly of claim 3 in which said first structural frame member is made of aluminum, and said channel shaped frame member is made of steel.

5. A refrigerator door assembly mountable within the opening in the wall of a refrigerated cabinet comprising a door mounting frame having an outer peripheral portion mountable within said cabinet opening, a plurality of insulated doors mounted for pivotal movement on said frame, said frame including at least one mullion extending between top and bottom sides thereof and against which said doors close, said mullion including a first metallic structural frame member, a second metallic frame member disposed rearwardly of said first frame member, a magnetically attractable sealing plate positioned forwardly of said first frame member against which said doors close, non-metallic insulating and retaining means surrounding said first structural frame member and supporting said sealing plate in thermally isolated relation to a front side of said first structural frame member, said insulating and retaining means including an insulating plate between said first and second frame members, and means interconnecting said first and second frame members with said insulating plate secured therebetween separating said first frame member from said second frame member.

6. The refrigerator door assembly of claim 5 in which said insulating and retaining means define air insulating spaces adjacent forward and opposite lateral sides of said first structural frame member.

7. The refrigerator door assembly of claim 5 in which said interconnecting means includes a stud connected between said frame members.

8. The refrigerator door assembly of claim 5 in which said insulating and retaining means includes means defining a front wall adjacent a front side of said first structural frame member and means defining side walls adjacent opposed lateral sides of said structural frame member, and said insulating plate is engageable with said side walls.

9. The refrigerator door assembly of claim 8 in which said side walls include means for releasably engaging and supporting said sealing plate in outwardly spaced relation to the front wall of said insulating and retaining means.

10. The refrigerator door assembly of claim 5 including a rigid plastic spacer plate interposed between said sealing plate and a front side of said first structural frame member, first fastener means connecting said spacer plate to said first structural frame member without contact with said sealing plate, and second fastener means connecting said sealing plate to said spacer plate without contact with said first structural frame member.

11. The refrigerator door assembly of claim 10 including a door accessory mounted on said sealing plate, and accessory fastener means for connecting said accessory to said spacer plate without contacting said first structural frame member.

12. The refrigerator door assembly of claim 5 in which said second frame member is a C-shaped channel having forwardly directed legs engaging said insulating plate.

13. The refrigerator door assembly of claim 12 in which said first structural frame member has a central hollow portion which defines a central air insulating space and outwardly extending flanges on opposed sides thereof.

14. The refrigerator door assembly of claim 13 in which said first frame member is made of aluminum, and said second frame member is made of steel.

15. A refrigerator door assembly mountable within the opening in the wall of a refrigerated cabinet comprising a door mounting frame having an outer peripheral portion mountable within said cabinet opening, a plurality of insulated doors mounted for pivotal movement on said frame, said frame including at least one mullion extending between top and bottom sides thereof and against which said doors close, said mullion including a first metallic structural frame member, a plastic insulating plate positioned rearwardly of said first metallic frame member, a metallic channel shaped frame member having forwardly directed legs engageable with said insulating plate, and means for interconnecting said first and channel shaped frame members with said plastic insulating plate interposed therebetween, said mullion including a forwardly positioned magnetically attractable plate against which said doors close, and non-metallic insulating and retaining means for supporting said sealing plate in thermally isolated relation to a front side of said first structural frame member.

16. The refrigerator door assembly of claim 15 in which said insulating and retaining means includes non-metallic means which encapsulate said first structural frame member.

17. The refrigerator door assembly of claim 16 in which insulating and retaining means define air insulating spaces adjacent forward and opposite lateral sides of said first structural frame member.

18. The refrigerator door assembly of claim 17 in which said insulating and retaining means includes said insulating plate and defines an air insulating space between said channel shaped frame member and a rear side of said first structural frame member.

19. The refrigerator door assembly of claim 17 in which said insulating and retaining means includes said insulating plate, and said insulating plate is rigidly interposed between said forwardly directed legs of said channel shaped frame member and said first structural frame member.

20. The refrigerator door assembly of claim 36 in which said insulating and retaining means includes means defining a front wall adjacent a front side of said first structural frame member and means defining side walls adjacent opposed lateral sides of said structural frame member, and said insulating plate is engageable with said side walls.

21. The refrigerator door assembly of claim 20 in which said side walls include means for releasably engaging and supporting said sealing plate in outwardly spaced relation to the front wall of said insulating and retaining means.

22. The refrigerator door assembly of claim 21 in which said side walls are formed with opposing channel shaped terminal ends for captively receiving opposed lateral sides of said sealing plate.

23. The refrigerator door assembly of claim 22 in which said side walls of said insulating and retaining member include first side walls extending rearwardly of the front wall of said insulating and retaining means at locations closely adjacent the opposed lateral sides of said structural frame member and second side walls disposed in outwardly spaced relation to said first side walls for defining air insulating spaces adjacent said lateral sides of said structural frame member.

24. The refrigerator door assembly of claim 23 in which said sealing plate retaining channels of said insulating and retaining member are formed at the forward terminal ends of said second side walls.

25. The refrigerator door assembly of claim 24 including fastener means for releasably connecting said first and second side walls to prevent disengagement of the opposite lateral sides of said sealing plate from said side wall channels.

26. The refrigerator door assembly of claim 15 including a rigid non-metallic spacer plate interposed between said sealing plate and said front wall of said first structural frame member, first fastener means connecting said spacer plate to said first structural frame member without contact with said sealing plate, and second fastener means connecting said sealing plate to said spacer plate without contact with said first structural frame member.

27. The refrigerator door assembly of claim 26 including a door accessory mounted on said sealing plate, and accessory fastener means for connecting said accessory to said spacer plate without contacting said first structural frame member.

28. The refrigerator door assembly of claim 26 in which said spacer plate is made of rigid plastic material.

29. The refrigerator door assembly of claim 36 in which said insulating and retaining means includes a channel shaped member having a front wall disposed in closely adjacent relation to a front side of said structural frame member and rearwardly directed side walls, and a cover plate which includes said insulating plate engageable with said rearwardly extending side walls for closing a rear side of said insulating and retaining means channel member.

30. A refrigerator door assembly mountable within the opening in the wall of a refrigerated cabinet comprising a door mounting frame having an outer peripheral portion mountable within said cabinet opening, a plurality of insulated doors mounted for pivotal movement on said frame, said frame including at least one mullion extending between top and bottom sides thereof and against which said doors close, said mullion including a first metallic structural frame member, a plastic insulating plate positioned rearwardly of said first metallic frame member, a metallic channel shaped frame member having forwardly directed legs engageable with said insulting plate, and means including a stud connected between said first structural frame member and said channel shaped frame member for interconnecting said first and channel shaped frame members with said plastic insulating plate interposed therebetween.

31. The refrigerator door assembly of claim 30 in which said stud includes a head intermediate its ends for forcing and retaining said insulating plate against a rear side of said structural plate against a rear side of said first structural frame member.

32. The refrigerator door assembly of claim 31 in which said stud has a forward end in engagement with said first structural frame member and a rear end extending through said channel shaped frame member, and a fastener engageable with said rear end of said stud for retaining said channel shaped member against said insulating plate.

33. A refrigerator door assembly mountable within the opening in the wall of a refrigerated cabinet comprising a door mounting frame having an outer peripheral portion mountable within said cabinet opening, a plurality of insulated doors mounted for pivotal movement on said frame, said frame including at least one mullion extending between top and bottom sides thereof and against which said doors close, said mullion including a first metallic structural frame member having a central hollow portion which defines a central air insulating space and outwardly extending flanges on opposed sides thereof, a plastic insulating plate positioned rearwardly of said first metallic frame member, a metallic channel shaped frame member having forwardly directed legs engageable with said insulating plate, and means for interconnecting said first and channel shaped frame members with said plastic insulating plate interposed therebetween.

34. The refrigerator door assembly of claim 33 in which said structural frame member hollow portion has an elongated cross sectional configuration with one long side thereof defining a front face of said structural frame member and a second long side defining a rear face of said structural frame member.

35. The refrigerator door assembly of claim 34 in which said outwardly extending flanges of said structural frame member extend outwardly from said hollow section with front sides thereof in substantially coplanar relation to said front face of said structural frame member.

* * * * *

UNITED STATES PATENT AND TRADEMARK OFFICE

CERTIFICATE OF CORRECTION

ATENT NO. : 4,941,289

ATED : July 17, 1990

NVENTOR(S) : Matthew Rolek

It is certified that error appears in the above-identified patent and that said Letters Patent is hereby orrected as shown below:

ol. 3, line 18, "he" should be -- the --.

ol. 4, line 9, after "thereof" insert a period.

ol. 6, line 39, "30'" should be -- 30 --.

ol. 9, lines 8-11, delete

"said mullion including a first metallic structural frame member, a plastic insulating plate positioned rearwardly of said first metallic frame member,.

ol. 10, line 66, after "which" insert -- said --.

ol. 11, line 12, "claim 36" should be -- claim 15 --.

ol. 11, line 62, "claim 36" should be -- claim 15 --.

UNITED STATES PATENT AND TRADEMARK OFFICE

CERTIFICATE OF CORRECTION

PATENT NO. : 4,941,289

DATED : July 17, 1990

INVENTOR(S) : Matthew Rolek

It is certified that error appears in the above-identified patent and that said Letters Patent is hereby corrected as shown below:

Col. 12, line 27, delete "structural plate against a rear side of said".

Signed and Sealed this

Twenty-seventh Day of April, 1993

*Attest:*

MICHAEL K. KIRK

*Attesting Officer*

*Acting Commissioner of Patents and Trademarks*